United States Patent [19]

Mahmoud

[11] Patent Number: 4,990,224

[45] Date of Patent: Feb. 5, 1991

[54] COPPER PLATING BATH AND PROCESS FOR DIFFICULT TO PLATE METALS

[75] Inventor: Issa S. Mahmoud, Austin, Tex.

[73] Assignee: International Business Machines Corporation, Armonk, N.Y.

[21] Appl. No.: 427,923

[22] Filed: Oct. 25, 1989

Related U.S. Application Data

[63] Continuation-in-part of Ser. No. 289,993, Dec. 21, 1988, abandoned.

[51] Int. Cl.[5] ..... C25D 3/38; C25D 5/30; C25D 5/38

[52] U.S. Cl. ..... 204/29; 204/52.1

[58] Field of Search ..... 204/52.1, 29

[56] References Cited

U.S. PATENT DOCUMENTS

| | | | |
|---|---|---|---|
| 3,732,151 | 5/1973 | Abbott | 204/52.1 |
| 3,769,179 | 10/1973 | Durose et al. | 204/24 |
| 3,923,613 | 12/1975 | Immel | 204/52.1 |
| 4,036,710 | 7/1977 | Kardos et al. | 204/52.1 |
| 4,242,181 | 12/1980 | Malak | 204/52.1 |
| 4,576,685 | 3/1986 | Goffredo et al. | 204/30 |
| 4,686,017 | 8/1987 | Young | 204/45.1 |

FOREIGN PATENT DOCUMENTS

| | | | |
|---|---|---|---|
| 901363 | 1/1982 | U.S.S.R. | 204/52.1 |

*Primary Examiner*—G. L. Kaplan

*Attorney, Agent, or Firm*—Andrea P. Bryant

[57] ABSTRACT

An acid copper plating bath and process for using with electropositive metals such as aluminum and tungsten is described, wherein the bath contains sulfuric acid, copper sulfate, in solution with urea as a levelling agent, a cationic surfactant as a wetting agent and an ester of a sulfonic acid, Beta-phenylethyltosylate as a brightening agent.

5 Claims, No Drawings

COPPER PLATING BATH AND PROCESS FOR DIFFICULT TO PLATE METALS

CROSS REFERENCE TO RELATED APPLICATION

This is a continuation-in-part of application Ser. No. 07/289,993 filed Dec. 21, 1988 and now abandoned.

DESCRIPTION

1. Field of the Invention

The present invention relates to electroplating baths. More particularly, it relates to a particular bath composition suitable for electroplating extremely electropositive metals such as aluminum and tungsten.

2. Background of the Invention

Strongly electropositive metals such as aluminum and tungsten are quite difficult to electroplate. Such metals have a strong affinity for atmospheric oxygen. This characteristic creates an ever present compacted oxide layer at the metal surface. Such a layer occurs within seconds after a fresh surface of these metals is exposed to oxygen. The oxide layer renders plating these metals very difficult; and if plating occurs, in many cases, the adhesion is quite poor.

Conventional techniques for plating such metals include extensive surface pre-treatment. In the case of tungsten, parts to be plated are often transferred from tank to tank while under electrical bias, thereby creating a safety hazard due to the possibility of electrical shock. Additionally, conventional plating processes for these metals generate significant amounts of harsh waste, such as hydrofluoric acid.

Thus, a better process and plating bath chemistry is desirable for plating these difficult to plate metals. U.S. Pat. No. 3,769,179 to Durose et al, U.S. Pat. Nos. 4,242,181 to Malak and 3,923,613 to Immel, exemplify the prior art of copper plating; the first two particularly, as applied to the printed circuit manufacturing industry.

SUMMARY OF THE INVENTION

The present invention provides a process including a bath formulation for depositing copper on difficult to plate metals such as aluminum and tungsten. The bath formulation of the present invention is an acid copper bath and includes additives for specific purposes.

The process of the present invention requires no surface preparation or etching prior to plating, thereby reducing the amount of chemical waste attendant to the process. Further, the present invention provides for oxide removal from difficult to plate metals in the plating tank so that there is minimal opportunity for new oxide to form on clean surfaces, thereby enabling the establishment of excellent metallic bonds between the electrodeposited copper and base metal.

The inventive process provides higher yields and better adhesion while minimizing the cost associated with waste treatment.

DESCRIPTION OF PREFERRED EMBODIMENT

The preferred aqueous plating solution contains sulfuric acid, 0.5–0.75 mols per liter; hydrated copper sulfate, 0.3–0.5 mols per liter; urea, 1–2 grams per liter; a wetting agent, 1–2 millileters per liter; tosyl or mesyl sulfonic acid ester, 1–2 grams per liter; and deionized water, 800–1000 milliliters.

More particularly, the preferred solution composition includes 0.5 mol. copper sulfate, 0.4 mol. sulfuric acid, 1 gram urea, 1 gram Beta-phenylethyltosylate (an ester of a sulfonic acid) and sufficient water to make one liter of solution. Preparation of the bath is preferably carried out as follows. About 700 milliliters of deionized or distilled water is measured into a 2,000 ml beaker, to which is added the above bath constituents in the order listed with continuous agitation. Subsequently, enough water is added to make one liter of solution which is then filtered to remove any undissolved reagents.

Urea is included for its properties as a levelling agent. Sulfonic acid ester is used for its brightening properties. It is to be noted that levelling agents may also be brightening agents when such agents merely improve the surface smoothness of deposits. Brightening agents are not also levelling agents when they incorporate, for example, as in the instant invention, sulfur in a coating to change the order of crystallinity and thus reflectance of the coating. In the preferred aqueous plating solution, the levelling agent has a synergistic effect with the brightening agent, providing a smooth, refined, reflective copper deposit.

Sulfonic acids of the ester type, particularly of the tosyl and mesyl types, are well suited for use in the present plating bath solution; since formation of sulfuric acid and a concurrent imbalance in the plating bath are to be avoided. Tosyl or mesyl groups are easily removed, which implies a breakdown with no by-products which would greatly increase the pH of the solution. Sulfonic acids of the ester type, particularly of the tosyl and mesyl types, are well suited for use in the present plating bath solution.

Suitable wetting agents include cationic surfactants such as sodium lauryl sulfate.

Metals to be plated are first cleaned to remove soil, dirt and other surface contaminants, then rinsed in deionized water. The metals are then placed in the plating tank containing the prepared bath.

Preferably, the parts remain in the plating solution for 2 to 3 minutes before a negative bias is applied to commence electroplating of copper. However, it has been noted that in some difficult cases, if the parts are given a positive bias for 30 to 60 seconds before the negative bias is applied, particularly stubborn, naturally grown oxide layers may be removed.

Normal plating process parameters include a bath temperature in the range of 20–30 degrees centigrade, at a current density of 10–20 amps per square foot, with continuous, strong agitation. The duration of the plating step is variable, depending on the desired copper thickness.

The sulfuric acid concentration in the plating bath is sufficient for removing the oxide layers during the 2–3 minute soak before introduction of current. No extensive surface preparation or etching is required before plating, thereby reducing the number of steps and the amount of chemical waste generated and the cost attendant thereto.

The following examples are illustrative of the various aspects of the invention.

EXAMPLES

Example 1

Aluminum and tungsten workpieces were cleaned in a mild alkaline cleaner and then plated in the following solution:

Sulfuric acid, 75 grams/liter
Copper sulfate, 72 grams/liter

Urea (leveling agent), 1 gram/liter
Sulfonic acid ester (brightener), 1 gram/liter
Sodium lauryl sulfate surfactant, 1 gram/liter
Deionized water sufficient to make 1 liter The workpieces were immersed in this solution for 2–3 minutes prior to biasing. Plating was carried out at room temperature and at 10 amps per square foot for 20 minutes. The copper deposits were smooth and free of defects such as skip plating. Testing for adhesion strength by both cross-cut and quench method showed no adhesion failures.

Example 2

Another example of this invention was carried out in a similar manner as Example 1, except the amount of sulfuric acid was reduced to 50 grams/liter. Again the quality and adhesion of the copper deposit were similar to Example 1.

Example 3

Another experiment was carried out as in Examples 1 and 2, except that the concentration of sulfuric acid was further reduced to 30 grams/liter. Subsequent adhesion testing showed failures at more than 25% of the tested areas.

Example 4

In another example the conditions were as in Example 1 except that the amount of copper sulfate was 50 grams/liter. The electrodeposits were smooth, free of skip plating and had excellent adhesion.

Example 5

Coupons of tungsten which showed slight blue color (tungsten oxide) were cleaned and then plated as in Example 1. Subsequent adhesion testing showed poor adhesion. However, when the coupons were first positively biased for 1 minute, then plated in the negative bias, the plated coupons showed good adhesion.

While the invention has been described having reference to a particular preferred embodiment, those having skill in the art will appreciate the various changes and detail will be made without departing from the spirit and scope of the invention as claimed.

I claim:

1. An acid copper plating bath for electropositive metals consisting essentially of:

0.5 to 0.75 mols per liter sulfuric acid,
0.3 to 0.5 mols per liter hydrated copper sulfate,
1 to 2 grams per liter, urea,
1 to 2 milliliters per liter, wetting agent,
1 to 2 grams per liter, Beta-phenylethyltosylate as a brightening agent, and
sufficient deionized water to make one liter.

2. The bath of claim 1 wherein the wetting agent is a cationic surfactant.

3. An aqueous acid copper electroplating bath composition for strongly electropositive metals such as aluminum and tungsten comprising:

sulfuric acid, 30–50 grams/liter;
hydrated copper sulfate, 50–72 grams/liter;
urea, 1 gram/liter;
Beta-phenylethyltosylate, 1 gram/liter; and
cationic surfactant, 1 gram/liter.

4. A process for copper plating electropositive metals comprising the steps of:

A. preparing a bath containing
0.5 to 0.75 mols per liter sulfuric acid,
0.3 to 0.5 mols per liter hydrated copper sulfate,
1 to 2 grams per liter, urea,
1 to 2 milliliters per liter, sodium lauryl sulfate,
1 to 2 grams per liter, a tosyl or mesyl sulfonic acid ester, and
sufficient deionized water to make one liter by first mixing components in order set out then filtering the solution;

B. soaking the parts to be plated in the bath for 2 to 3 minutes; and

C. electrodepositing copper from the bath,
at a temperature of about 20 to 30 degrees centigrade,
at a current density of 10 to 20 amperes per square foot,
with continuous agitation.

5. The process of claim 4 wherein the soaking step is replaced by soaking for 30 to 60 seconds, under the influence of a positive bias.

* * * * *

UNITED STATES PATENT AND TRADEMARK OFFICE

CERTIFICATE OF CORRECTION

PATENT NO. : 4,990,224

DATED : February 5, 1991

INVENTOR(S) : Issa S. Mahmoud

It is certified that error appears in the above-identified patent and that said Letters Patent is hereby corrected as shown below:

Col. 4, line 20, after "liter" insert --with continuous agitation--.

Signed and Sealed this

Thirtieth Day of June, 1992

*Attest:*

DOUGLAS B. COMER

*Attesting Officer*

*Acting Commissioner of Patents and Trademarks*